US009840786B2

(12) United States Patent
Sato et al.

(10) Patent No.: US 9,840,786 B2
(45) Date of Patent: *Dec. 12, 2017

(54) FILM DEPOSITION DEVICE OF METAL FILM AND FILM DEPOSITION METHOD

(71) Applicant: TOYOTA JIDOSHA KABUSHIKI KAISHA, Toyota-shi, Aichi-ken (JP)

(72) Inventors: Yuki Sato, Nagakute (JP); Hiroshi Yanagimoto, Miyoshi (JP); Motoki Hiraoka, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 5 days.

This patent is subject to a terminal disclaimer.

(21) Appl. No.: 14/910,365

(22) PCT Filed: Aug. 4, 2014

(86) PCT No.: PCT/IB2014/001454

§ 371 (c)(1),
(2) Date: Feb. 5, 2016

(87) PCT Pub. No.: WO2015/019152

PCT Pub. Date: Feb. 12, 2015

(65) Prior Publication Data

US 2016/0177464 A1 Jun. 23, 2016

(30) Foreign Application Priority Data

Aug. 7, 2013 (JP) ..... 2013-163815

(51) Int. Cl.
*C25D 5/02* (2006.01)
*C25D 17/14* (2006.01)
(Continued)

(52) U.S. Cl.
CPC ..... *C25D 5/22* (2013.01); *C25D 5/02* (2013.01); *C25D 5/08* (2013.01); *C25D 17/00* (2013.01);
(Continued)

(58) Field of Classification Search
CPC ..... C25D 17/002; C25D 17/10; C25D 17/14; C25D 5/02
See application file for complete search history.

(56) References Cited

U.S. PATENT DOCUMENTS 4,326,930 A 4/1982 Nagel et al.
6,277,261 B1 8/2001 Divisek et al.
(Continued)

FOREIGN PATENT DOCUMENTS

JP 01-165786 A 6/1989
JP 05-070986 A 3/1993
(Continued)

OTHER PUBLICATIONS

Database WPI Week 198932 Thomson Scientific, London, GB; AN 1989-231016 XP002735308.
(Continued)

*Primary Examiner* — Bryan D. Ripa
(74) *Attorney, Agent, or Firm* — Sughrue Mion, PLLC

(57) ABSTRACT

A film deposition device (1A) of a metal film includes: a solid electrolyte membrane (13) that allows metal ions to be contained; a positive electrode (11) made of a porous body; a power supply part (14) that applies a voltage between the positive electrode and a base material; and a contact pressurization part (20) that comes into contact with the positive electrode (11) and uniformly pressurizes a film deposition region of a surface of the base material by the solid electrolyte membrane (13) via the positive electrode (11). The positive electrode (11) made of the porous body is capable of transmitting a solution containing the metal ions such that the metal ions are supplied to the solid electrolyte membrane. The power supply part (14) applies a voltage between the positive electrode and the base material so that the metal film made of the metal is deposited.

10 Claims, 6 Drawing Sheets

(51) Int. Cl.

| | |
|---|---|
| ***C25D 5/22*** | (2006.01) |
| ***C25D 5/08*** | (2006.01) |
| ***C25D 17/00*** | (2006.01) |
| ***C25D 17/10*** | (2006.01) |
| ***C25D 21/00*** | (2006.01) |

(52) U.S. Cl.
CPC ..... *C25D 17/002* (2013.01); *C25D 17/10* (2013.01); *C25D 17/14* (2013.01); *C25D 21/00* (2013.01)

(56) References Cited

U.S. PATENT DOCUMENTS

| | | | | |
|---|---|---|---|---|
| 7,998,323 | B1 | 8/2011 | Chandra et al. | |
| 2006/0199270 | A1 | 9/2006 | Parnas et al. | |
| 2008/0217182 | A1 | 9/2008 | Dai | |
| 2010/0040927 | A1 | 2/2010 | Yoshida et al. | |
| 2014/0224662 | A1* | 8/2014 | Arumugam | C25D 5/06 205/93 |
| 2015/0014178 | A1* | 1/2015 | Hiraoka | C25D 5/08 205/261 |

FOREIGN PATENT DOCUMENTS

| | | | | | |
|---|---|---|---|---|---|
| JP | 05148681 | A | * | 6/1993 | C25D 5/04 |
| JP | 10-121282 | A | | 5/1998 | |
| JP | 2002-004091 | A | | 1/2002 | |
| JP | 2004-353014 | A | | 12/2004 | |
| JP | 2005-133187 | A | | 5/2005 | |
| JP | 2008-097868 | A | | 4/2008 | |
| JP | 2010-037622 | A | | 2/2010 | |
| JP | 2011-011493 | A | | 1/2011 | |
| JP | 2012-219362 | A | | 11/2012 | |
| JP | 2012219362 | A | * | 11/2012 | C25D 17/00 |
| WO | 2006/067337 | A2 | | 6/2006 | |

OTHER PUBLICATIONS

Partial Translation of Office Action dated Nov. 18, 2015 in corresponding JP Application No. 2013-163815.

International Search Report for International Application No. PCT/1132014/001454 dated Feb. 17, 2015.

International Search Report, issued by International Searching Authority in corresponding International Application No. PCT/IB2014/001459, dated Feb. 9, 2015.

A Restriction Requirement dated May 16, 2017, which issued by the USPTO in U.S. Appl. No. 14/910,416.

An Office Action dated Sep. 1, 2017, which issued during the prosecution of U.S. Appl. No. 14/910,416.

* cited by examiner

FILM DEPOSITION DEVICE OF METAL FILM AND FILM DEPOSITION METHOD

BACKGROUND OF THE INVENTION

1. Field of the Invention

The invention relates to a film deposition device and a film deposition method of a metal film, in particular, a film deposition device and a film deposition method of a metal film, which can deposit a thin metal film uniformly on a surface of a base material.

2. Description of Related Art

Heretofore, when an electronic circuit base material or the like is manufactured, in order to form a metal circuit pattern, a metal film is deposited on a surface of a base material. For example, as a film deposition method of such a metal film, a film deposition technique in which a metal film is deposited on a surface of a semiconductor base material such as Si by plating such as electroless plating or the like (see Japanese Patent Application Publication No. 2010-037622 (JP 2010-037622 A), for example) and a film deposition technique in which a metal film is deposited by a PVD method such as sputtering have been proposed.

However, in the case where plating such as the electroless plating was applied, water cleansing was necessary after the plating, and an waste liquid after water cleansing was necessary to be treated. Further, when a film was deposited on a surface of a base material by a PVD method such as sputtering, since an internal stress was formed in a deposited metal film, a film thickness was limited from being thickened, in particular, in the case of sputtering, in some cases, the film deposition was possible only under high vacuum.

In view of points like this, for example, a film deposition method of a metal film, which uses a positive electrode, a negative electrode, a solid electrolyte membrane disposed between the positive electrode and negative electrode, and a power supply part that applies a voltage between the positive electrode and negative electrode is proposed (see JP 2012-219362 A, for example).

Here, the solid electrolyte membrane is formed in such a manner that a solution containing a precursor of a solid electrolyte is spin coated on a surface of a base material in advance and cured, and metal ions to be coated on the solid electrolyte membrane are impregnated. Then, the solid electrolyte membrane is faced to the positive electrode and the base material is disposed so as to be electrically connected with the negative electrode. By applying a voltage between the positive electrode and negative electrode, the metal ions impregnated inside the solid electrolyte are precipitated on a negative electrode side thereby. Thus, a metal film made of metal of the metal ions can be deposited.

However, when the technique described in Japanese Patent Application Publication No. 2012-219362 (JP 2012-219362 A) was used, in some cases, in a contact part (contact surface) between the solid electrolyte membrane and the base material, irregularities in contact pressure were generated. When a metal film is deposited in a state in which such irregularities of contact pressure were generated in a region where the metal film is deposited of a surface of the base material, there was a possibility of inducing irregularities in a film thickness of the metal film.

SUMMARY OF THE INVENTION

The present invention provides a film deposition device and a film deposition method of a metal film, which can deposit a metal film having a uniform film thickness.

A first aspect of the present invention relates to a film deposition device of a metal film, which includes: a solid electrolyte membrane that allows metal ions to be contained; a positive electrode made of a porous body; a power supply part that applies a voltage between the positive electrode and the base material; and a contact pressurization part that comes into contact with the positive electrode and uniformly pressurizes a film deposition region of a surface of the base material on which the metal film is deposited via the solid electrolyte membrane in contact with the positive electrode by the positive electrode. The positive electrode made of the porous body is capable of transmitting a solution containing the metal ions such that the metal ions are supplied to the solid electrolyte membrane. The power supply part applies a voltage between the positive electrode and the base material in a state in which the solid electrolyte membrane is disposed on a surface of the positive electrode between the positive electrode and the base material to be a negative electrode. By this voltage application, metal is precipitated from the metal ions on a surface of the base material and the metal film made of the metal is deposited.

According to the present invention, during film deposition, in a state in which the solid electrolyte membrane is disposed on the positive electrode, the solid electrolyte membrane is brought into contact with the base material. When, in this state, a voltage is applied between the positive electrode and the base material to be a negative electrode by a power supply part, metal can be precipitated on a surface of the base material from metal ions contained inside of the solid electrolyte membrane thereby. As a result, a metal film made of metal of the metal ions can be deposited on a surface of the base material.

Here, the positive electrode is a porous body, the positive electrode made of the porous body can transmit a solution containing metal ions to the inside, and can supply the transmitted solution (of metal ions) to the solid electrolyte membrane. Thus, during film deposition, the solution containing the metal ions can be supplied as needed via the positive electrode that is a porous body. The solution containing supplied metal ions transmits the inside of the positive electrode, comes into contact with the solid electrolyte membrane adjacent to the positive electrode, and the metal ions are impregnated in the solid electrolyte membrane thereby.

As a result like this, the metal ions in the solid electrolyte membrane are precipitated and are supplied from the positive electrode side during film deposition. Thus, without limiting an amount of metal that can be precipitated, a metal film having a desired film thickness can be continuously deposited on surfaces of a plurality of base materials.

Further, according to the present invention, when a metal film is deposited, a surface of the positive electrode (that is, a surface of the positive electrode coincident with the film deposition region) corresponding to a film deposition region on which a metal film is deposited of a surface of the base material can be pressurized by a contact pressurization part. Thus, since the film deposition region of the base material can be uniformly pressurized by the solid electrolyte membrane, in a state in which the solid electrolyte membrane is made to uniformly fit a film deposition region of the base material, a metal film can be deposited on the base material. As a result like this, a homogeneous metal film having a uniform film thickness with small variations can be deposited on a surface to be a film deposition region of the base material.

Here, as described above, during metal film deposition, as long as the contact pressurization part can uniformly pressurize the film deposition region of the base material, a structure of the film deposition device is not particularly restricted. However, the film deposition device includes a metal ion supply part that houses the positive electrode and supplies a solution containing the metal ions to the positive electrode, the metal ion supply part includes a flow path that introduces the solution to the metal ion supply part, circulates the solution in the metal ion supply part and discharges the solution from the metal ion supply part, the contact pressurization part is disposed inside of the metal ion supply part, and the positive electrode may be disposed in the metal ion supply part such that a flow path through which the solution passes is formed in the positive electrode as a part of the flow path.

According to the present invention, since a flow path for flowing a solution containing metal ions is formed in the positive electrode that is a porous body, the solution containing the metal ions introduced in the metal ion supply part is supplied to the positive electrode as needed. Therefore, even if the metal ions in the solid electrolyte membrane are consumed during film deposition, the metal ions can be continuously and stably supplied to the solid electrolyte membrane. Thus, the deposition speed of the metal film can be made higher.

As a second aspect of the present invention, a film deposition method of a metal film includes: sandwiching a solid electrolyte membrane with a positive electrode and a base material to be a negative electrode such that the solid electrolyte membrane comes into contact with the positive electrode and the base material; containing metal ions in the solid electrolyte membrane; and depositing a metal film made of the metal on a surface of the base material by applying a voltage between the positive electrode and the base material so that metal from metal ions contained inside the solid electrolyte membrane is precipitated on a surface of the base material. As the positive electrode, a porous body that is capable of transmitting a solution containing the metal ions is used such that the metal ions are supplied to the solid electrolyte membrane. When the metal film is deposited, the positive electrode uniformly pressurizes a film deposition region of a surface of the base material on which the metal film is deposited via the solid electrolyte membrane. After the solid electrolyte membrane is disposed on a surface of the positive electrode between the positive electrode and the base material to be a negative electrode, the solid electrolyte membrane may be brought into contact with the base material.

According to the present invention, the solid electrolyte membrane is disposed on a surface of the positive electrode, and the solid electrolyte membrane is brought into contact with the base material. In this state, by applying a voltage between the positive electrode and the base material, metal is precipitated on a surface of the base material from metal ions contained inside of the solid electrolyte membrane, and a metal film can be deposited on a surface of the base material thereby.

Here, by using the positive electrode made of the porous body, a solution containing the metal ions can be transmitted to the inside of the porous body, and the transmitted solution can be supplied to the solid electrolyte membrane. Thus, during film deposition, a solution containing metal ions can be supplied as needed via the positive electrode that is a porous body. A supplied solution containing the metal ions transmits the inside of the positive electrode and comes into contact with the solid electrolyte membrane adjacent to the positive electrode, and the metal ions are impregnated in the solid electrolyte membrane thereby.

As a result like this, the metal ions in the solid electrolyte membrane are precipitated and are supplied from the positive electrode side during film deposition. Thus, without limiting an amount of metal that can be precipitated, a metal film having a desired film thickness can be continuously deposited on surfaces of a plurality of base materials.

Further, in the present invention, when a metal film is deposited, a surface of the positive electrode corresponding to a film deposition region of a surface of the base material on which a metal film is deposited is pressurized against the base material, and the film deposition region of the base material can be uniformly pressurized by the solid electrolyte membrane. Thus, in a state in which the solid electrolyte membrane is made to uniformly fit a film deposition region of the base material, a metal film can be deposited on the base material. As a result like this, a homogeneous metal film having a uniform film thickness with small variations can be deposited on a surface to be a film deposition region of the base material.

When the film deposition method described above is performed, the solution containing the metal ions may be intermittently supplied to the positive electrode to deposit a metal film. While making the solution containing the metal ions pass to the inside of the positive electrode, the metal film may be deposited.

In order to flow the solution containing the metal ions to the inside of the positive electrode that is a porous body, the solution containing the metal ions, which was introduced to the metal ion supply part, is supplied to the positive electrode as needed. Therefore, even if the metal ions in the solid electrolyte membrane are consumed during film deposition, the metal ions can be continuously and stably supplied to the solid electrolyte membrane. Thus, the deposition speed of the metal film can be improved.

According to the present invention, a metal film of which film thickness is suppressed from varying can be deposited.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, a film deposition device by which film deposition methods of a metal film according to two embodiments of the present invention can be preferably performed will be described.

[First Embodiment]

Figure 1:
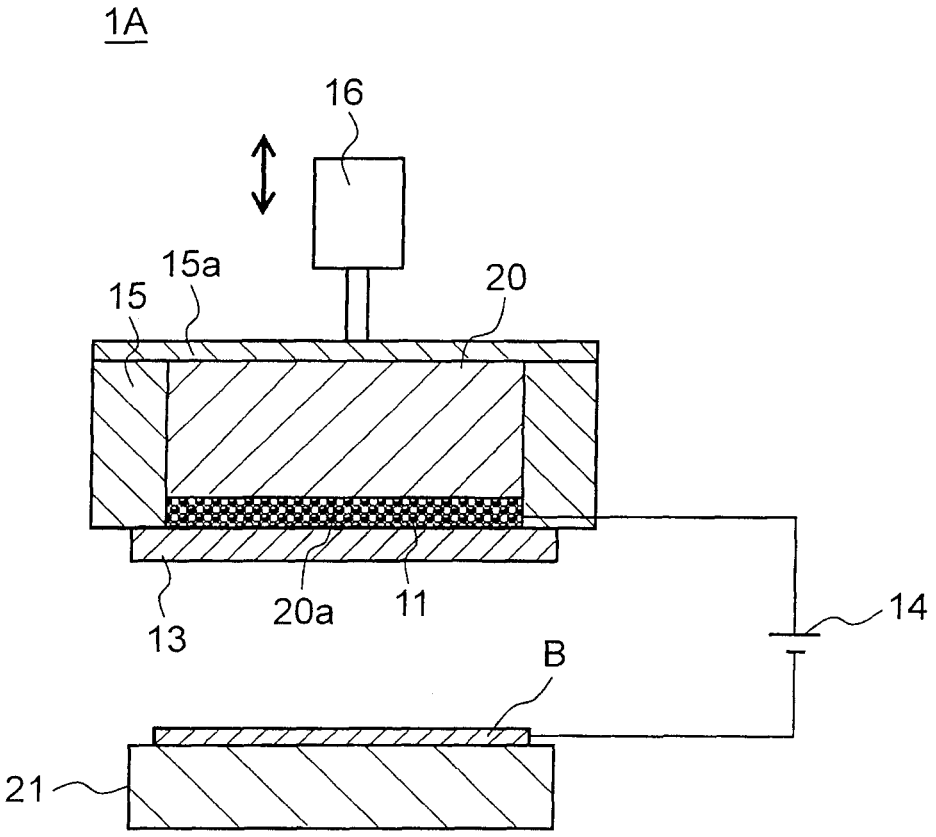
FIG. 1 is a schematic conceptual view of a film deposition device of a metal film according to a first embodiment of the present invention.

As shown in FIG. 1, a film deposition device 1A according to an embodiment of the present invention precipitates metal from metal ions and deposits a metal film made of precipitated metal on a surface of a base material B. Here, as the base material B, a base material made of a metal material such as aluminum, or a base material obtained by forming a metal underlayer on a treatment surface of a resin or a silicon base material is used.

The film deposition device 1A includes at least a metallic positive electrode 11, a solid electrolyte membrane 13 disposed on a surface of the positive electrode 11 between the positive electrode 11 and the base material B to be a negative electrode, and a power supply part 14 that applies a voltage between the positive electrode 11 and the base material B.

Figure 2A:
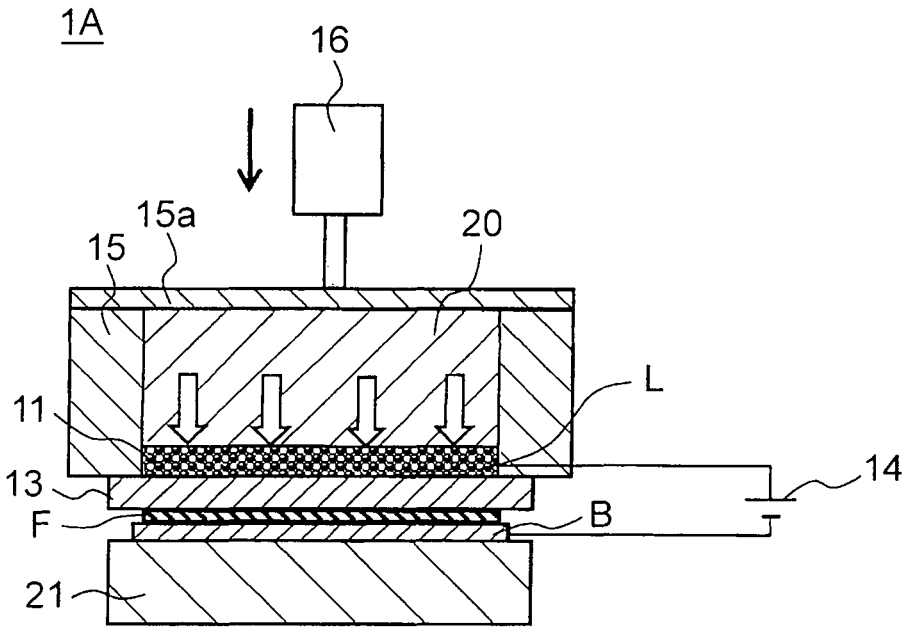
FIG. 2A is a schematic cross-sectional view for describing a film deposition method according to a film deposition device of a metal film shown in FIG. 1 and a state during film deposition by the film deposition device.
Figure 2B:
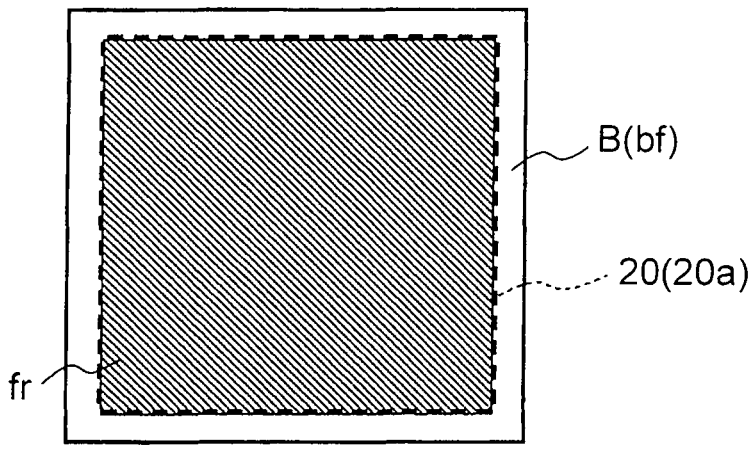
FIG. 2B is a schematic plan view for describing a positional relationship between a surface (region) against which a positive electrode shown in FIG. 2A is pressurized and a film deposition region of a base material.

Further, the film deposition device 1A includes a contact pressurization part 20 that is in contact with the positive electrode 11 and pressurizes a surface of the base material B by the solid electrolyte membrane 13 via the positive electrode 11 during film deposition. Specifically, as shown in FIG. 2B, the contact pressurization part 20 pressurizes a surface of the positive electrode 11 corresponding to a film deposition region fr such that the film deposition region fr on which a metal film F is deposited of a surface bf of the base material B is uniformly pressurized during film deposition. The film deposition region fr is a flat surface. Further, in a state in which the solid electrolyte membrane 13 is in contact with the positive electrode 11, a surface of the solid electrolyte membrane 13 that faces the film deposition region fr is a flat surface.

That is, in the present embodiment, when viewing from a vertical direction (pressurization direction), the film deposition region fr (region hatched in FIG. 2B) of the base material B coincides with a region (a region surrounded by a dashed line in FIG. 2B) 20*a* of a surface against which the contact pressurization part 20 pressurizes the positive electrode 11.

The positive electrode 11 and the contact pressurization part 20, which are described above, are housed in a frame body 15. More specifically, in a bottom of the frame body 15, an opening is formed, the positive electrode 11 is housed in a state in which the positive electrode 11 is engaged with an inner wall in an internal space of the frame body 15, and the solid electrolyte membrane 13 is installed to the frame body 15 such that it comes into contact with the positive electrode 11 and covers the opening of the frame body 15.

The positive electrode 11 has a lower surface corresponding to a size of the film deposition region fr of the base material B, and above the positive electrode 11, the contact pressurization part 20 is disposed so as to coincide with an upper surface of the positive electrode 11. Thus, as detailed below, the contact pressurization part 20 pressurizes an entire surface of the upper surface of the positive electrode 11 by a pressurization means 16 described below and can uniformly pressurize a whole region of the film deposition region fr via the solid electrolyte membrane 13 by a lower surface of the positive electrode 11.

When the positive electrode 11 and the contact pressurization part 20 are housed in the frame body 15, a cap part 15*a* above the frame body 15 is removed and the contact pressurization part 20 may be housed in the frame body 15. That is, as long as a positional relationship between the contact pressurization part 20 and the positive electrode 11, which were described above can be satisfied, a structure of the frame body 15 is not particularly limited. Further, the contact pressurization part 20 is not particularly limited in a shape thereof as long as it can uniformly pressurize the positive electrode 11. The contact pressurization part 20 may be made of a metal material, in this case, since the contact pressurization part 20 and the positive electrode 11 are in direct contact and are electrically connected, the positive electrode 11 and the contact pressurization part 20 can be electrically connected to the power supply part 14.

The positive electrode 11 is made of a porous body that transmits a metal ion solution L and supplies metal, ions to the solid electrolyte membrane 13. As such a porous body, as long as it has (1) corrosion resistance against the metal ion solution L, (2) the electric conductivity capable of operating as a positive electrode, (3) permeability of the metal ion solution L, and (4) capability of pressurizing via the contact pressurization part 20 by a pressurization means 16 described below, it is not particularly limited. For example, a foamed metal body made of a foam having continuous open cells, which has an ionization tendency lower than plating metal ion (or higher in an electrode potential), such as foamed titanium can be used.

The condition of (3) described above is preferable to be the porosity of about 50 to 90% by volume, a pore diameter of about 50 to 600 μm, and a thickness of about 0.1 to 50 mm when a foamed metal body is used, for example.

According to the present embodiment, when a film is deposited, a solution containing metal ions (hereinafter, referred to as a metal ion solution) L is supplied to the positive electrode 11. As described below, since the positive electrode 11 is made of a porous body, the metal ion solution L can be held inside thereof.

Further, the pressurization means 16 is connected to the cap part 15*a* of the frame body 15. The pressurization means 16 pressurizes the positive electrode 11 via the pressurization part 20 described above when the positive electrode 11 is moved toward the base material B, and the solid electrolyte membrane 13 is pressurized against the film deposition region fr of the base material B thereby. For example, as the pressurization means 16, a hydraulic or air cylinder and so on can be used.

The film deposition device 1A includes a pedestal 21 that fixes the base material B and adjusts alignment of the base material B with respect to the positive electrode 11, and the pedestal 21 includes also a temperature adjustment mechanism that adjusts a temperature of the base material B.

As the metal ion solution L, an aqueous solution that contains ions of, for example, copper, nickel, silver or the like can be used. For example, in the case of copper ion, a solution containing copper sulfate, copper pyrophosphate or the like can be used. As the solid electrolyte membrane 13, a membrane, a film or the like made of a solid electrolyte can be used.

The solid electrolyte membrane 13 is not particularly limited as long as, when brought into contact with the metal ion solution L described above, the metal ions can be impregnated inside thereof, and, when a voltage is applied, metal derived from the metal ions can be precipitated on a surface of the base material B. As a material of the solid electrolyte membrane, a fluororesin such as Nafion (registered trade mark) manufactured by DuPont, a hydrocarbon resin, a polyamic acid resin, or a resin having an ion exchange function such as SELEMION (CMV, CMD, CMF series) manufactured by ASAHI GLASS Co., Ltd. can be used.

Hereinafter, a film deposition method according to the present embodiment will be described. Firstly, on the pedestal 21, the base material B is disposed, alignment of the base material B is adjusted with respect to the positive electrode 11, and a temperature of the base material B is adjusted. Next, as shown in FIG. 2A, the solid electrolyte membrane 13 is disposed on a surface of the positive electrode 11 that is made of a porous body, the solid electrolyte membrane 13 is brought into contact with the base material B.

Then, by means of the pressurization means 16, the positive electrode 11 is moved toward the base material B, and the film deposition region fr of the base material B is pressurized by the solid electrolyte membrane 13 thereby. Specifically, the film deposition region fr on which a metal film F is deposited of a surface of the base material B can be uniformly pressurized by the contact pressurization part 20. Thus, the solid electrolyte membrane 13 can be made to uniformly fit a surface of the base material B of the film deposition region fr.

Next, the power supply part 14 is used to apply a voltage between the positive electrode 11 and the base material B to be a negative electrode, and metal is precipitated from the metal ions contained inside of the solid electrolyte membrane 13 on a surface of the base material B thereby. At this time, since the metal ion solution L is held inside of the positive electrode 11, while supplying the metal ion solution L on a surface on the solid electrolyte membrane 13 side from the inside of the positive electrode 11, a metal film F can be deposited.

As a result like this, by use of the positive electrode 11 made of a porous body, the metal ion solution L can be transmitted from the inside thereof to the solid electrolyte membrane 13 side, and the transmitted metal ion solution L can be supplied to the solid electrolyte membrane 13 together with the metal ions. Thus, during film deposition, the metal ion solution L inside of the positive electrode 11 that is a porous body can be supplied. The supplied metal ion solution L comes into contact with the solid electrolyte membrane 13 adjacent to the positive electrode 11, and the metal ions are impregnated in the solid electrolyte membrane 13.

Then, when a voltage is applied between the positive electrode 11 and the base material B to be a negative electrode, the metal ions inside of the solid electrolyte membrane 13 supplied from the inside of the positive electrode 11 move from the positive electrode 11 toward the base material B side, metal is precipitated from the metal ions contained in the solid electrolyte membrane 13 on a surface of the base material B. Thus, a metal film F can be deposited on a surface of the base material B.

Since the metal ion solution L in the positive electrode 11 that is a porous body can be supplied like this, without limiting an amount of metal that can be precipitated, a metal film F having a desired film thickness can be continuously deposited on surfaces of a plurality of base materials B.

According to the present embodiment, since the film deposition region fr of the base material B can be uniformly pressurized with the solid electrolyte membrane 13 by the contact pressurization part 20, in a state in which the solid electrolyte membrane 13 is made to fit the film deposition region fr of the base material B, a metal film can be deposited on a base material B. As a result like this, a homogeneous metal film having a uniform film thickness with small variations can be deposited on a surface to be a film deposition region fr of the base material B.

[Second Embodiment]

Figure 3A:
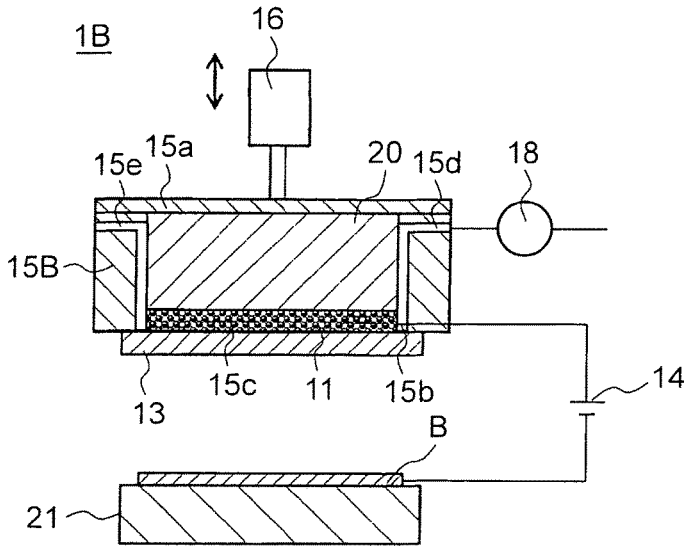
FIG. 3A is a schematic cross-sectional view that shows a state before film deposition by the film deposition device of a metal film according to a second embodiment of the present invention.

A different point of a film deposition device 1B according to a second embodiment shown in FIG. 3A from a film deposition device 1A according to the first embodiment is in that a function of supplying a metal ion solution to the positive electrode 11 was imparted to the frame body 15 shown in first embodiment. That is, according to the present embodiment, a frame body that houses the positive electrode 11 becomes a metal ion supply part 15B for supplying the metal ion solution to the positive electrode 11.

Figure 3B:
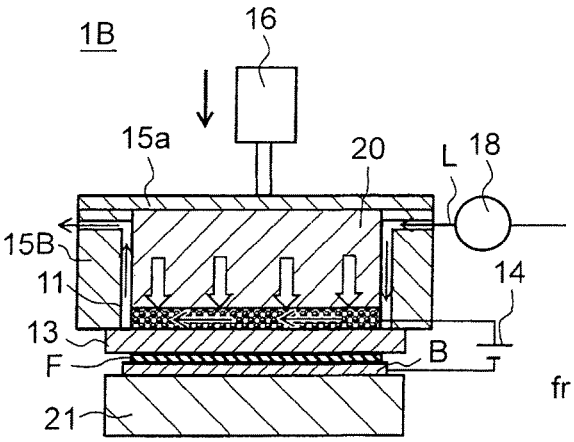
FIG. 3B is a schematic plan view for describing a state during film deposition by the film deposition device shown in FIG. 3A.

As shown in FIG. 3A and FIG. 3B, a flow path 15*e* that introduces the metal ion solution L in the metal ion supply part 15B, supplies the metal ion solution L into the metal ion supply part 15B, and discharges the metal ion solution L is formed. The contact pressurization part 20 is disposed in the metal ion supply part 15B such that a flow path 15*c* through which the metal ion solution L passes is formed in the positive electrode 11 as a part of a flow path 15*b*.

Specifically, with side surfaces of the contact pressurization part 20 and the positive electrode 11 and an inner surface of the metal ion supply part 15B, a flow path 15*d* that guides the metal ion solution L into the positive electrode 11 and a flow path 15*e* that discharges the metal ion solution L from the positive electrode 11 are formed. Further, since the positive electrode 11 is sandwiched (clamped) by the contact pressurization part 20 and the solid electrolyte membrane 13, a flow path through which the metal ion solution L flows is formed in the porous positive electrode 11 between the contact pressurization part 20 and the solid electrolyte membrane 13. As a result like this, like dashed line arrow marks of FIG. 3C, to an entire surface of the positive electrode 11, the metal ion solution L can be flowed.

A solution tank (not shown) in which the metal ion solution L is housed is connected to one side of the metal ion supply part 15B via a pumping device (a device that pumps the metal ion solution L to a flow path of the metal ion supply part) 18 such as a pump for transferring a solution and a supply tube, and, on the other side thereof, an waste liquid tank (not shown) that recovers the used waste liquid is connected via an waste liquid tube. By configuring like this, the metal ion solution L housed in the solution tank can be forcibly supplied by the pumping device 18 to the flow path 15*b* of the metal ion supply part and the positive electrode 11 via the supply tube and the used waste liquid can be transferred to the waste liquid tank via the waste liquid tube.

Figure 3C:
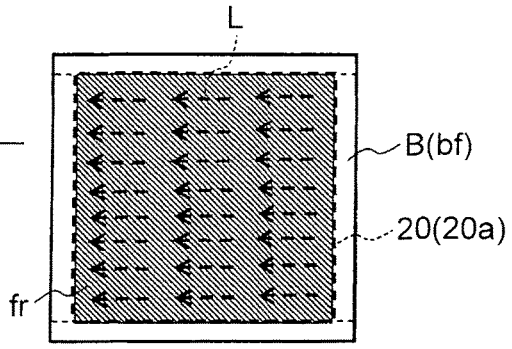
FIG. 3C is a schematic plan view for describing a positional relationship between the surface (region) against which the positive electrode shown in FIG. 3A is pressurized and the film deposition region of the base material and a flow of a metal ion solution.

According to the second embodiment, in addition to the effects of the first embodiment, since a flow path 15*c* for flowing the metal ion solution L is formed in the positive electrode 11 that is a porous body, as shown in FIG. 3C, the metal ion solution L introduced in the metal ion supply part 15B can be forcibly supplied (flowed) as needed over an entire surface of the positive electrode 11. Thus, even if the metal ions in the solid electrolyte membrane 13 are consumed during film deposition, the metal ions can be continuously and stably supplied to the solid electrolyte membrane 13. Therefore, a film deposition speed of the metal film F can be increased.

The present invention will be described with reference to the following examples.

EXAMPLE 1

By use of a device shown in FIG. 3A described above, a metal film was deposited. As a base material on a surface of which a film is deposited, a pure aluminum base material (50 mm×50 mm×thickness 1 mm, an area of a film deposition region: 30 mm×30 mm) was prepared, on a surface thereof a nickel plating film was formed, further a gold plating film was formed on a surface of the nickel plating film. Next, a positive electrode coated with platinum plating at a thickness of 3 μm on a surface for film deposition that corresponds to a film deposition region was used on a surface of a porous body (manufactured by Mitsubishi Material Corporation) that is made of a 30 mm×30 mm×0.5 mm foamed titanium.

As the solid electrolyte membrane, an electrolyte membrane having a film thickness of 183 μm (Nafion N117, manufactured by DuPont) was used. As the metal ion solution, a solution of 1 mol/L copper sulfate was prepared, under conditions of a flow rate of the metal ion solution L of 15 ml/minute, a voltage of a power supply of 1.6 V, and a treatment time of 60 minutes, while pressurizing at 0.5 MPa from above the positive electrode, a film deposition was performed. A film thickness of the deposited film was measured, and by use of the following equation, a variation in a film thickness was calculated. These results are shown in Table 1, FIGS. 5A and 5B.

Variation of film thickness on a thicker side (%)= (maximum film thickness−average film thickness)/average film thickness×100

Variation of film thickness on a thinner side (%)= (average film thickness−minimum film thickness)/average film thickness×100

COMPARATIVE EXAMPLE 1

Figure 4A:
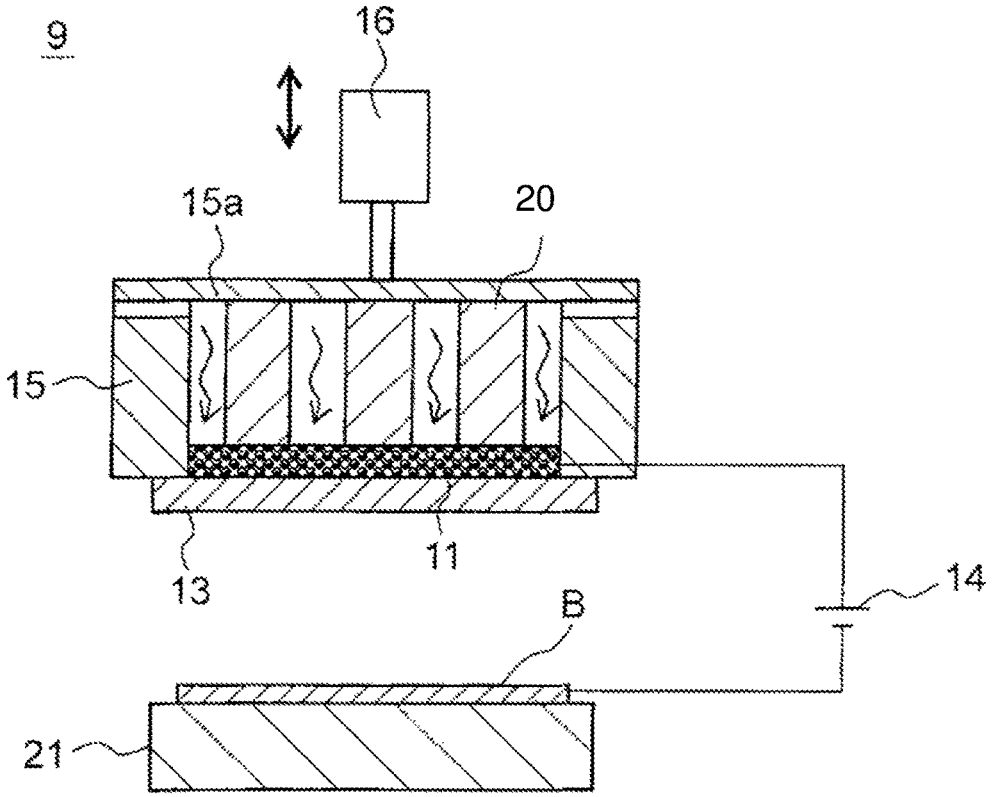
FIG. 4A is a schematic conceptual view showing a film deposition device of a metal film according to a comparative example.
Figure 4B:
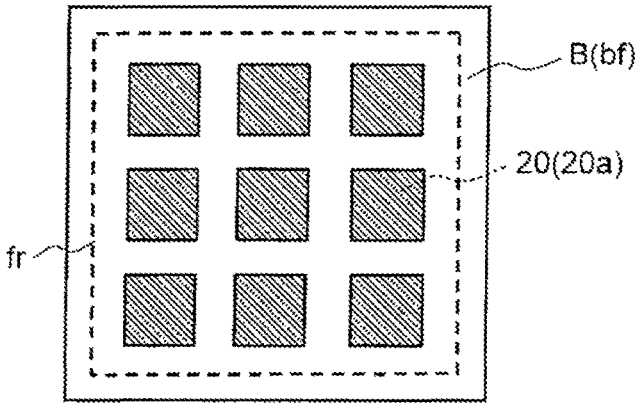
FIG. 4B is a schematic plan view for describing a positional relationship between a surface (region) against which a positive electrode shown in FIG. 4A is pressurized and a film deposition region of a base material.

In Comparative Example 1, in the same manner as Example 1, a metal film was deposited. A different point from Example 1 is that like a deposition device 9 shown in FIGS. 4A and 4B, 9 contact pressurization parts that come into partial contact with a surface 20*a* of the positive electrode and pressurize this were used. A pressurization area of each of the contact pressurization parts was 5 mm×5 mm and these were arranged at equidistance in 3 rows×3 columns. In the same manner as Example 1, film thicknesses of deposited films were measured, and, in what follows, variations in film thicknesses on a thicker side and a thinner side were calculated. These results are shown in Table 1 and FIG. 5.

TABLE 1

| | Comparative Example 1 | Example 1 |
|---|---|---|
| Measured film thickness (μm) | 4.95 | 12.26 |
| | 5.16 | 12.04 |
| | 4.73 | 12.47 |
| | 4.52 | 12.47 |
| | 1.95 | 9.46 |
| | 1.73 | 10.54 |
| Film thickness variation on thicker side (%) | 34 | 8 |
| Film thickness variation on thinner side (%) | 55 | 18 |

Figure 5A:
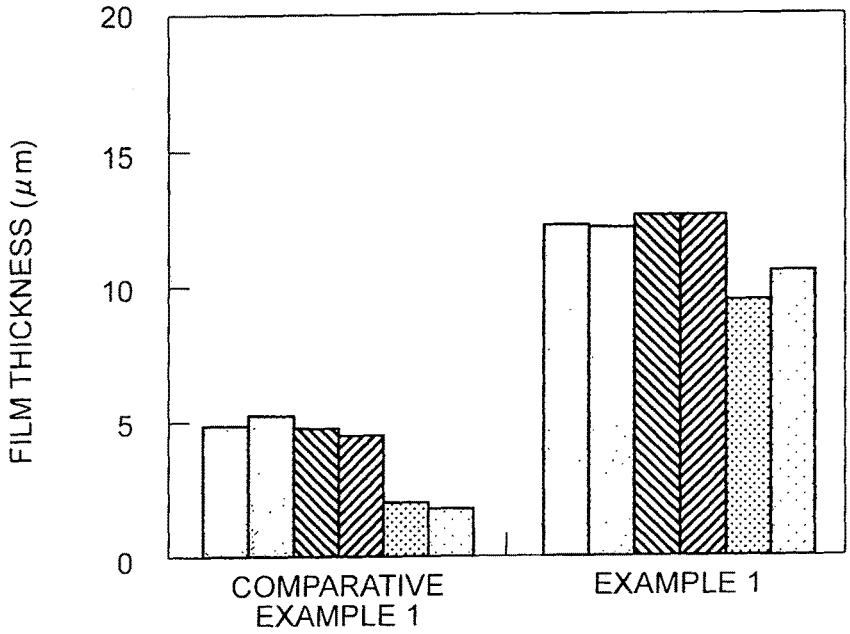
FIG. 5A is a diagram that shows measurement results of film thicknesses of metal films deposited according to film deposition methods of example 1 and comparative example 1.
Figure 5B:
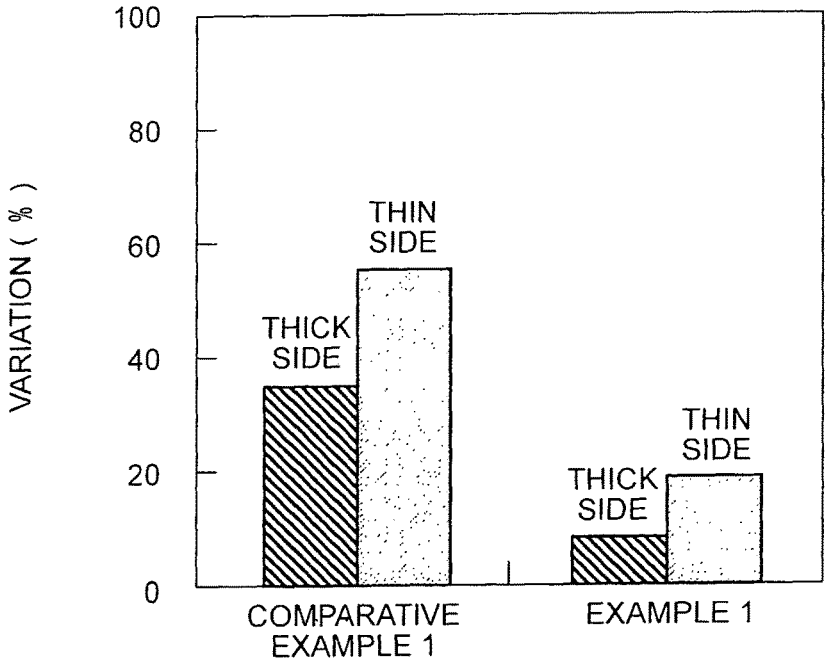
FIG. 5B is a diagram that shows variations of the film thicknesses of the metal films deposited by the film deposition methods according to example 1 and comparative example 1.

(Result 1) As shown in FIG. 5A, 5B and Table 1, it is found that metal films deposited by use of the film deposition device according to Example 1 have relatively uniform film thicknesses compared with Comparative Example 1, that is, the variation is small. This is considered because the film deposition device according to Example 1 can uniformly pressurize the film deposition region of the base material with the solid electrolyte membrane by pressurizing the positive electrode corresponding to the film deposition region by the contact pressurization part during film deposition.

EXAMPLE 2

Figure 6:
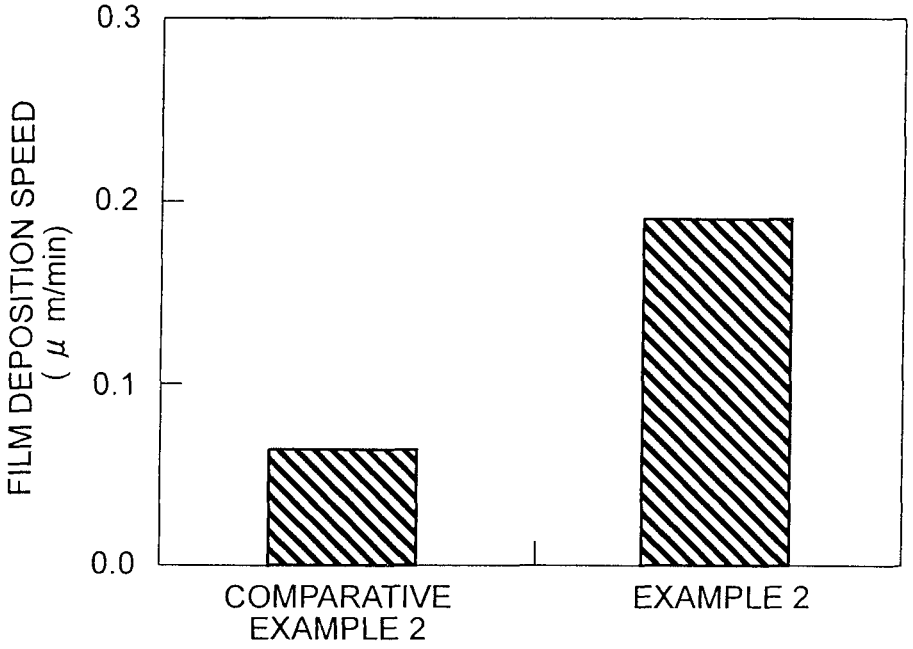
FIG. 6 is a diagram that shows results of deposition speeds when films were deposited by the film deposition methods according to example 2 and comparative example 2.

In the same manner as Example 1, a metal film was deposited. A film deposition speed of the metal film when deposited with the film deposition device of Example 2 was measured. Results thereof are shown in the following Table 2 and FIG. 6.

COMPARATIVE EXAMPLE 2

In the same manner as Example 2, a metal film was deposited. A point different from Example 2 is that by using 9 contact pressurization parts that come into partial contact with a surface of the positive electrode and pressurize this like the film deposition device 9 shown in FIGS. 4A and 4B, a film deposition device in which a flow path through which the metal ion solution passes into the positive electrode as a part of the flow path is not formed was used to deposit the metal film. That is, in Comparative Example 2, without passing a solution containing metal ions to the inside of the positive electrode, a film was deposited. A film deposition speed of the metal film when deposited with the film deposition device of Example 2 was measured. Results thereof are shown in the following Table 2 and FIG. 6.

TABLE 2

| | Comparative Example 2 | Example 2 |
|---|---|---|
| Film Deposition Speed (μm/minute) | 0.064 | 0.19 |

(Result 2) The reason that the film deposition speed of Example 2 was larger than that of Comparative Example 2 was considered because the metal ion solution could be forcibly supplied to the whole of the positive electrode as needed by forming a flow path for flowing the metal ion solution L to the inside of the positive electrode that is a porous body.

In the above, embodiments of the present invention were detailed. However, the present invention is not limited to the embodiments described above, and various design changes can be performed.

The invention claimed is:

1. A film deposition device of a metal film, comprising:

a solid electrolyte membrane that allows metal ions to be contained;

a positive electrode made of a porous body that is capable of transmitting a solution containing the metal ions such that the metal ions are supplied to the solid electrolyte membrane;

a power supply part that applies a voltage between the positive electrode and a base material in a state in which the solid electrolyte membrane is disposed on a surface of the positive electrode between the positive electrode and the base material to be a negative electrode such that a metal film made of metal is deposited by precipitating the metal from the metal ions on a surface of the base material; and a contact pressurization part that uniformly pressurizes a film deposition region of the surface of the base material on which the metal film is deposited via the solid electrolyte membrane that is in contact with the positive electrode by the positive electrode.

2. The film deposition device according to claim 1, further comprising:

a metal ion supply part that houses the positive electrode and supplies the solution to the positive electrode, wherein the metal ion supply part includes a flow path that introduces the solution to the metal ion supply part, circulates the solution into the metal ion supply part, and discharges the solution from the metal ion supply part;

the contact pressurization part is disposed in the metal ion supply part; and the positive electrode is disposed in the metal ion supply part such that a flow path through which the solution passes into the positive electrode is formed as a part of the flow path.

3. The film deposition device according to claim 1, wherein the solid electrolyte membrane is a resin.

4. The film deposition device according to claim 1, wherein the contact pressurization part is metal.

5. The film deposition device according to claim 1, wherein each of surfaces of the film deposition region of the base material and the solid electrolyte membrane that faces the film deposition region is a flat surface.

6. A film deposition method of a metal film comprising:

sandwiching a solid electrolyte membrane with a positive electrode and a base material to be a negative electrode such that the solid electrolyte membrane comes into contact with the positive electrode and the base material;

containing metal ions in the solid electrolyte membrane;

depositing a metal film made of metal on a surface of the base material by precipitating the metal from the metal ions contained inside of the solid electrolyte membrane by applying a voltage between the positive electrode and the base material, wherein, as the positive electrode, a porous body that is capable of transmitting a solution containing the metal ions is used such that the metal ions are supplied to the solid electrolyte membrane, and when the metal film is deposited, a film deposition region on which the metal film of the surface of the base material is deposited is uniformly pressurized via the solid electrolyte membrane by the positive electrode.

7. The film deposition method according to claim 6, further comprising disposing the solid electrolyte membrane on a surface of the positive electrode between the positive electrode and the base material prior to the step of sandwiching.

8. The film deposition method according to claim 6, wherein the metal film is deposited while passing the solution into the positive electrode.

9. The film deposition method according to claim 6, wherein the solid electrolyte membrane is a resin.

10. The film deposition method according to claim 6, wherein each of surfaces of the film deposition region of the base material and the solid electrolyte membrane that faces the film deposition region is a flat surface.

* * * * *